United States Patent [19]

Saurenman

[11] 3,991,779

[45] Nov. 16, 1976

[54] MEDICAL EQUIPMENT CLEANING SYSTEM

[75] Inventor: Dean Saurenman, Pearland, Tex.

[73] Assignee: Del Tek, Inc., Houston, Tex.

[22] Filed: Apr. 19, 1974

[21] Appl. No.: 462,299

[52] U.S. Cl. ..... 134/57 R; 134/102; 134/159; 21/98; 21/105

[51] Int. Cl.[2] ..... B08B 3/06

[58] Field of Search ..... 134/57 R, 95, 102, 107, 134/157, 159, 56 R, 56 D, 57 D; 21/98, 99, 105, 107

[56] References Cited

UNITED STATES PATENTS

| | | | |
|---|---|---|---|
| 729,536 | 6/1903 | Brown | 134/156 |
| 1,261,778 | 4/1918 | Deming | 134/95 |
| 2,195,615 | 4/1940 | Chamberlin et al. | 134/57 D |
| 2,357,909 | 9/1944 | Ridge | 134/57 R |
| 3,316,925 | 5/1967 | Schroeder | 134/95 X |
| 3,739,791 | 6/1973 | Fry et al. | 134/157 |
| 3,853,622 | 12/1974 | Rutten | 134/157 X |

*Primary Examiner*—Robert L. Bleutge

[57] ABSTRACT

A system for cleaning and disinfecting medical parts which include a drum rotatable about a horizontal axis where the drum includes an interior enclosable chamber for receiving small parts and circumferential retaining members for receiving and retaining tubular members about the horizontal axis. A timing device sequentially control the operation upon filling by washing, draining, rinsing and drying in sequence and structure is provided to accomplish these functions.

6 Claims, 5 Drawing Figures

FIG. 1
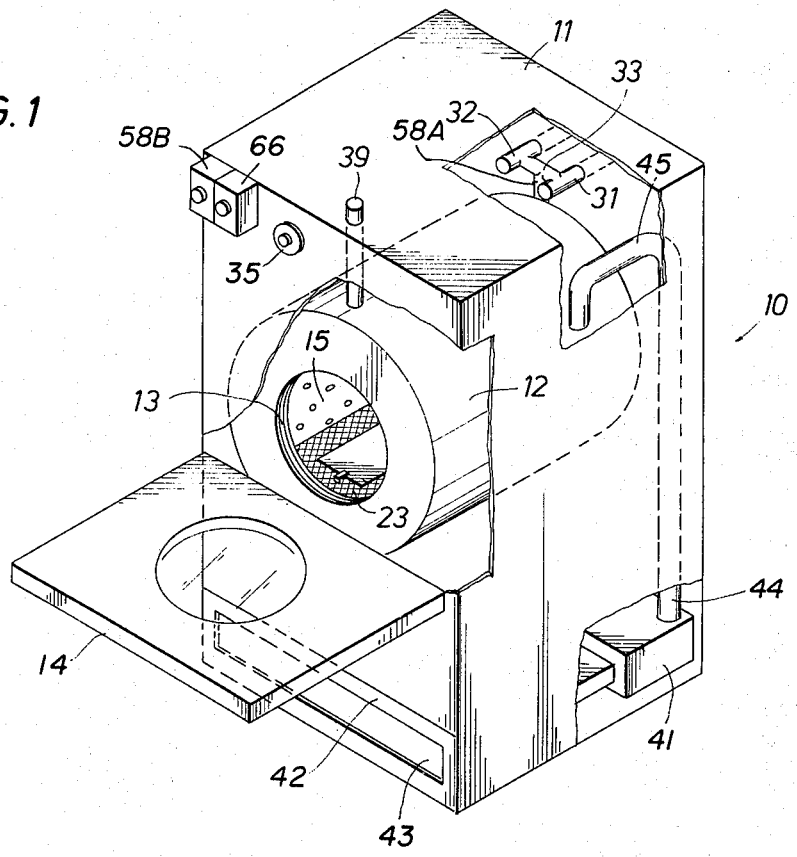
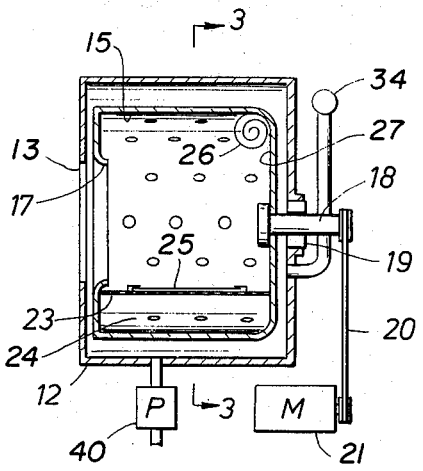
FIG. 2
FIG. 3
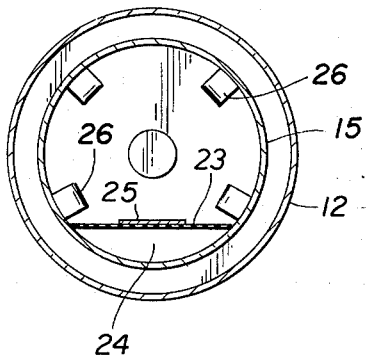

MEDICAL EQUIPMENT CLEANING SYSTEM

BACKGROUND OF THE INVENTION

This invention relates to apparatus for cleaning and disinfecting medical equipment, and more particularly, to machine operated functions to improve cleanliness and disinfection of medical equipment.

Hospital acquired infection pose serious problems, and, to a large extent, may be a function of the cleaning and disinfecting procedures. It is established procedure to use hand washing techniques for cleaning and disinfecting. In recent years, technology has brought an abundance of throw-away parts and tubing to the medical profession. Nonetheless, it is desirable and it may become more necessary in the future for ecological purposes to clean and disinfect medical equipment for reuse.

Cleaning and disinfecting techniques for medical equipment should include, in addition to a thorough cleaning, removal of all organic matter, destruction of vegetative organisms, removal of all traces of detergent or other chemical additives, and adequate drying. Hand washing techniques are imprecise and are not as effective as machine washing techniques. Machine washing techniques can provide clear advantage over hand washing, provided that the apparatus is capable of achieving the desired cleaning, disinfecting and drying. Accordingly, it is the purpose of the present invention to provide new and improved machine cleaning and disinfecting systems for medical equipment.

SUMMARY OF THE INVENTION

The present invention includes an apparatus which can machine wash and disinfect, rinse and spray medical equipment in an automatic time cycle. The apparatus has a side loaded, rotatable washing drum which has a separate compartment for receiving small parts for cleaning and disinfecting. A circumferentially disposed set of negatorsprings permit a looping of tubing about the rotational axis for the drum and retention of the tubing relative to the drum so that rotation induces and forces flow of liquid through the tubing. Means are provided to fill the drum with wash water and add a disinfectant. Rotation of the drum for a wash period is timed by a timing mechanism which causes draining of the drum following the wash, spray rinsing and finally the application of a forced draft hot air during a drying period. The drying system includes a hot air duct system to draw air through a vertical, chemically treated filter to a fan and heater which forces air into the drum.

BRIEF DESCRIPTION OF THE DRAWINGS

The drawing illustrating features of the present invention in conjunction with the specification include:

FIG. 1 which is a perspective representation of the organization and some details of the apparatus of the present invention;

FIG. 2 which is a cross-section view and schematic representation of the washing apparatus;

FIG. 3 which is a cross-section view taken along line 3—3 of FIG. 2;

DESCRIPTION OF THE INVENTION

Figure 4:
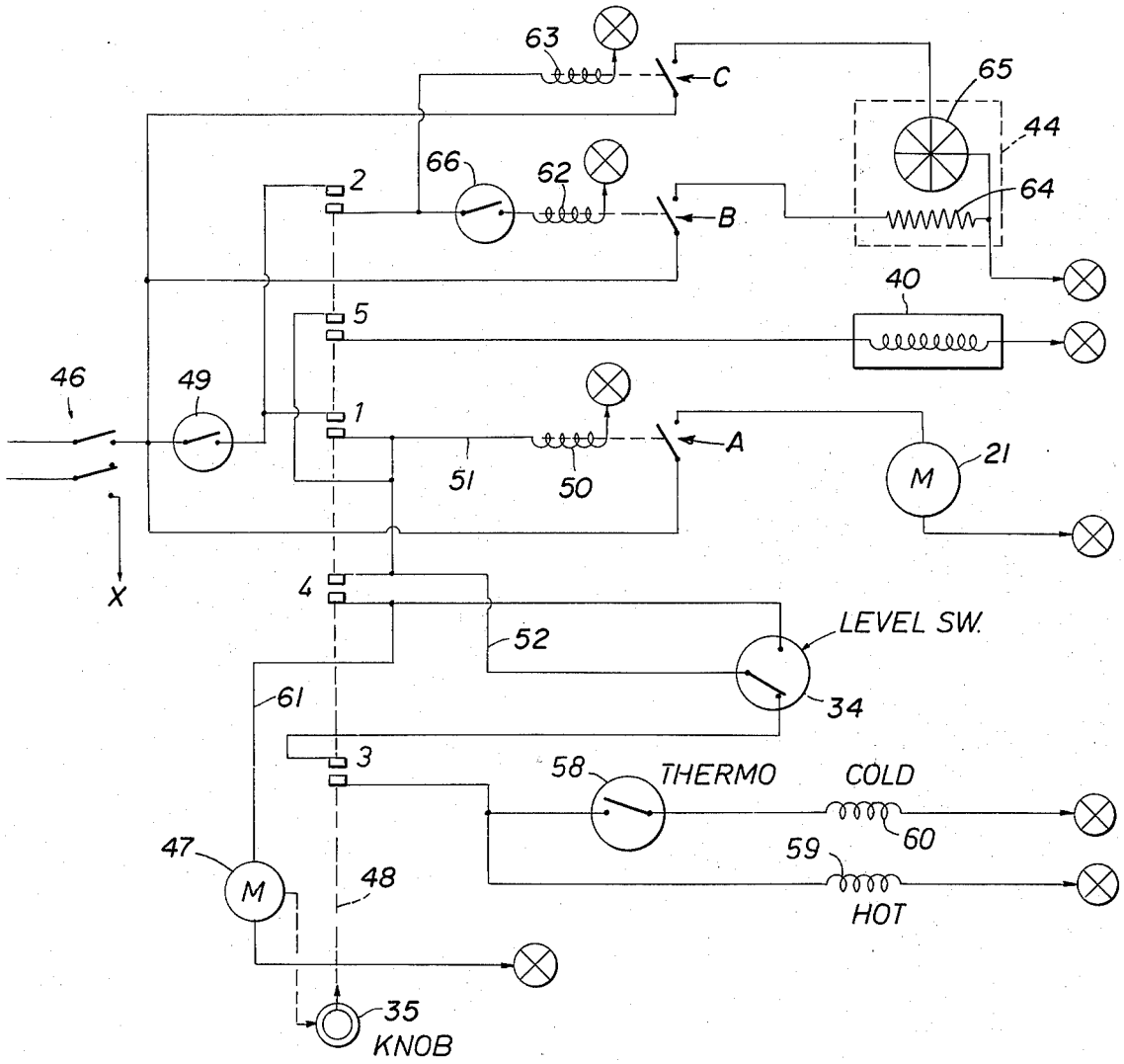
FIG. 4 which is a schematic electrical representation of the electrical system for the present invention.

Referring now to the drawings, an apparatus 10 for cleaning and disinfecting rubber, plastic, glass or metal medical parts or equipment is illustrated in FIG. 1. The apparatus of the present invention includes some common components and functional relationships to existing household washing machines which will be apparent from the discussion which follows. The apparatus 10, as shown in FIG. 1, has a typical rectangular outer configuration and a front opening. This style of apparatus is sometimes referred to as a "side-loading" machine because of the side opening. The apparatus 10 includes a frame and cabinet assembly 11 which houses a stationary tub 12 with a side opening 13. A hinged door 14 on the frame is arranged to seal with respect to the tub opening 13 so that the tub and door provide an enclosed liquid disinfectant washing chamber. The tub 12 is constructed of corrosion resistant material or is porcelain coated. The tube is a cylindrically shaped container. Concentrically arranged within the tube 12 is a perforated, procelain coated, cylindrically shaped drum 15 with a cylindrically shaped, side opening 17 (FIG. 2) disposed and aligned with tube opening 13. The drum 15 is supported within the tub for rotation by means of a central axle 18 (FIG. 2) which is sealingly received by and rotatively supported by a tub bearing 19. The center axis for the tub bearing 19 is the axis of rotation for the drum 15. A pulley and belt connection 20 external to the tub 12 couples the axle 18 to an electrical driving motor 21. Thus, the motor 21 provides a driving means for rotating the drum 15 within the tub 12. The tub 12 is stationary and connected to the frame.

Within the drum 15, along a chord of its cylindrical shape is a transverse, flat, perforated surface 23, which together with the corresponding circular arc segment of the drum, forms an enclosure or chamber 24 within the drum. An access lid 25 is hinge connected across an opening in the surface 23 and a clasp is provided for retaining the lid in a closed position. In the remaining open area of the drum 15 are four circumferentially spaced negator type springs 26. A spring 26, as shown in FIGS. 2 and 3, has one outer end attached to a cylindrical wall of the drum and is curled so that the opening between adjacent coil surfaces faces toward the rearward side wall 27 of the drum. In the practice of the present invention, small parts to be cleaned are disposed in the chamber 24. Tubing to be cleaned is disposed within the drum in a circular fashion by being inserted into the center spacing between the negator spring coils 26 so that the springs retain the tubing in a cylindrical manner within the drum 15. The springs contact upon the tubing to hold it in position relative to the drum and can be expanded or contracted by their spring action to handle various sizes of tubing coils.

In the practice of the present invention, the parts and/or tubing to be chemically disinfected are placed within the enclosure 24 and the rotatable drum and secured in place. The door 14 is closed and the operation initiated by beginning the fill cycle. During the fill cycle, the drum is rotated by the motor 21 while hot wash water and a cleaning disinfectant are introduced into the tub. The wash water is introduced from input supplies (not shown) which are respectively connected to hot and cold water inlet valves 31 and 32 (see FIG. 1). The outlets for the valves 31 and 32 couple to a common input pipe 33 which enters to the tub so that a temperature mixed water is injected into the tub. A water level valve 34 is schematically illustrated in FIG. 2 as attached to the tub 12. The water level valve 34 is operated by the level of water relative to a predetermined point or level in the tub. The water level valve 34 closes one set of electrical contacts when the water level is above the predetermined point and closes another set of electrical contacts, when or if the water level is below the predetermined point. The water level value 34 is used to initiate operation of a cycle timing motor and to control operation of the water inlet valves. To actuate the water inlet valves 31 and 32, a conventional switch and timing control knob 35 is used. The timing control knob is a part of a cycle timing system to initiate a cycle of operation which includes filling the tub with water, rotating the drum, pumping out the water, spraying, and drying by hot air. As will be apparent from the discussion to follow, the cycle is automatic. The disinfectant is introduced into the tub 12 by means of a vertical tube 39 which extends between the outside of the cabinet and the interior of the tub 12. The tube 39 also serves as a choke outlet for the hot air drying.

After the water level in the tub reaches th predetermined point and the disinfectant is added, the drum 15 continues rotation for a time period adequate to wash and disinfect the components within the tub. After the washing period, the timing motor (which was actuated by the water level valve 34) discontinues or disconnects the water valves 31 and 32 from operation and a discharge pump 40 (FIG. 2) is actuated to discharge the liquid from the tub. Following this, the water valves 31 and 32 can be actuated for rinsing or spray purposes. After rinsing, the pump operation is discontinued and a drying cycle is initiated. For the hot air drying cycle, as shown in FIG. 1, a heating and fan unit 14 is connected to a format opening inlet 42. Disinfecting filter means 43 are disposed in the opening inlet 42 to treat the input air to the fan unit 41. The output of fan unit 41 is to a vertical pipe 44 which has a U-shaped return bend 45 located above the tub 12 and which opens to the upper surface of the tub. This U-shaped configuration located above the tub prevents liquid from access to the drying system.

Figure 5:
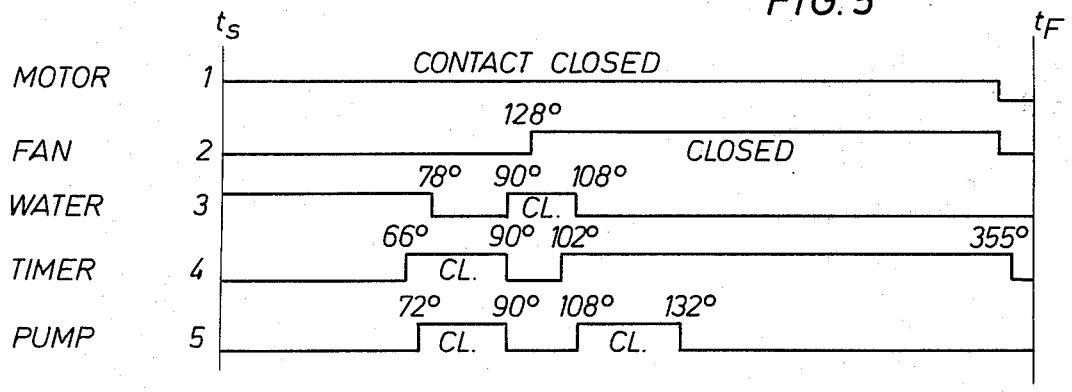
FIG. 5 which is a timing diagram for the sequence of operation.

Referring now to FIG. 4, an electrical schematic layout illustrates the various electrical components while FIG. 5 illustrates a timing sequence. At a time $t_s$, a main manual switch 46 is thrown to apply an alternating current from a power supply to the electrical system of the unit. The manual switch 46 may be incorporated in the push-pull rotating knob switch 35, if desired. The rotating knob switch 35 includes a timer motor 47 to produce a 360° rotation of the knob switch 35 and an associated cam shaft illustrated by the dashed line 48. The cam shaft 48 has cams (not shown) thereon which control the opening and closing of switches 1 – 5 throughout the time that the shaft 48 is rotated by the timer motor 47. At the time $t_s$, the cams for switch 1 and 3 cause the switch contacts to assume a closed condition. Switch 1 has its contacts closed for 351° of the cam shaft rotation from the time $t_s$. The manual switch 46 is in series with a door switch 49 and one of the switch 1 contacts so that upon the closing of the door 14 on the machine and switch 46, electrical power is applied switch 1 contacts and thence to a solenoid switch relay coil 50 by a conductor 51 and to the water level switch 34 by a conductor 52. The solenoid relay 50, when energized, closes a heavy duty switch A which applies operating power from the electrical source to the motor 21 so that the drum 15 is rotated. The water level switch 34, in the position shown for its contacts, connects the switch 1 contacts to the switch 3 contact. The switch 3 contacts are closed for the initial 78° of the cam shaft rotation, opened between cam shaft positions of 79° and 90°, closed between cam shaft positions of 90° and 108°, and then opened for the remainder of the cam shaft rotation through 360°. When the switch 3 contacts are closed, electrical power is applied to a thermostat control switch 58 and to a hot water solenoid coil 59. The solenoid coil 59, when energized, operates the hot water valve 32 to admit water to the inlet pipe 33. As illustrated in FIG. 1, the thermostat sensor 58a is in the water inlet line 33 and when the temperature level reaches the thermostat setting, the thermostat switch 58 closes its contacts so that a cold water solenoid 60 is energized to operate the cold water valve 31 to supply cold water to the inlet pipe 33. When the water temperature decreases to the lower thermostat level, the contacts of the thermostat switch are opened, and the cold water solenoid coil 60 is de-energized. The control switch 58 is adjustable by a control 58b to any desired temperature.

Next in the sequence of operation, the water level in the drum reaches a predetermined level and the water level switch 34 is operated to disconnect the switch 1 contacts and the power supply from the water valve control solenoids 59 and 60. The water level switch 34 when it changes contact positions, connects the switch 1 contacts to the switch 4 and to the timer motor 47 via a conductor 61. The timer motor 47, in turn, produces a rotation of the timer knob 35 and cam shaft 48 to provide the automatic control of the operation.

Just prior to the time that switch 3 contacts are opened at 78° of the cam shaft rotation, the switch 4 contacts are closed at 66° of cam shaft rotation. The closing of switch 4 contacts maintains power to the timer motor 47 even if the water level switch 34 changes position. Switch 4 contacts are closed between 66° and 90° of cam shaft rotation and from 102° of cam shaft rotation to the end of the cycle.

The switch 5 contacts are closed by the cam shaft rotation between 72° and 90° and between 108° and 132°. Closing of the switch 5 contacts energizes the coil of the pump 40 to discharge water during these time periods.

The switch 2 contacts are closed from 128° through 351° of the cam shaft rotation. Closing of switch 2 contacts energizes solenoid coils 62 and 63 for the power relay switches B and C. Power relay switch B couples the electrical power to a Cal-Rod heating element 64 in the fan unit 41 while power relay switch C couples the electrical power to the fan element 65. An adjustable thermostat switch 66 is located in the connection to the coil 62 so that the temperature of the hot air can be controlled. The sensing element for the thermostat can be located in the outlet vent pipe 39.

The following table may be helpful in relation to the timing cycle.

TABLE I

| Minutes | Function |
|---|---|
| 0 to Fill | Tub filled with regulated temperature water and disinfectant added |
| Full – 11 | Wash |
| 11 – 15 | Drain, and Spray Rinse |
| 15 – 18 | Water Rinse |

TABLE I-continued

| Minutes | Function |
|---|---|
| 19 - 22 | Drain |
| 19 - 59 | Hot Air Dry |

In the operation of this invention, an air drying temperature of about 145° F is satisfactory. A water temperature of 145° F to 170° F for washing has been found as satisfactory.

The fan and heating unit can be a squirrel cage blower and a "cal-rod" heating element where the hot air outlet duct to the tub is 3 inch in diameter and the vent pipe from the tub is 1 inch in diameter. The 1 inch outlet diameter from the tub restricts the outlet air flow and retains the heat in the tub for effective drying. The speed of the drum is constant between 40 to 45 rpm.

The negator springs 26 can be berrylium copper. Their gripping power is a function of width and thickness and can be adjusted as desired. The filter 43 is a polyester material 4 inch thick which is treated with "CONSAN 20" to make it bacteriostatic. This can be 4 layers of 1 inch thick material. The chemical treatment involves dipping the filter in a solution of 2½ oz. of CONSAN 20 per gallon of water and drying the filters. It will also be noted in connection with the filter and air opening that they are in a vertical plane. This takes advantage of the fact that bacteria does not adhere to vertical walls. The amount of wash water used is about 7 gallons and, of course, is a function of tub size.

In summary, the enclosure is filled with medical equipment parts small enough to be put in the compartment 24. The compartment enclosure 24 should preferably be overfilled so that when the lid is closed, the equipment is pressed in and hence tumbling of parts is prevented. Rubber parts such as masks should be included in the enclosure whenever possible to help hold the parts immobile and to act as a cushion. Tubing are coiled in the drum and fastened by the negator 26 so that a tubing coil revolves just as the drum does. The tubings are tucked between the negator spring coils and the outer diameter of the drum.

When the door 14 of the machine is closed, the power can be turned on. The disinfectant, such as ½ oz. of CONSAN 20 should be added through the fill vent 39. When the tub 12 is filled with water to the washing level, the automatic cycle is started by the level valve 34 and the parts are cleaned and disinfected during the cycle of operation.

While particular embodiments of the present invention have been shown and described, it is apparent that changes and modifications may be made without departing from this invention in its broader aspects; and therefore, the aim in the appended claims is to cover all such changes and modifications as fall within th true spirit and scope of this invention.

What is claimed is:

1. An apparatus for cleaning and disinfecting medical equipment including enclosure means for receiving and retaining a cleaning and disinfecting solution, said enclosure means including a drum rotatably mounted with respect to a horizontal axis, means in said drum for releasably retaining medical parts fixed with respect to said drum, means for supplying temperature controlled water for a cleaning and disinfecting solution to said enclosure means including a hot and cold inlet supply means and a common discharge means from said supply means to said enclosure means, and means in said discharge means for sensing the temperature of water therein and for regulating the flow of water through one of said hot and cold inlet supply means for controlling the temperature of the inlet water.

2. An apparatus for cleaning and disinfecting medical equipment including enclosure means for receiving and retaining a cleaning and disinfecting solution, said enclosure means including a drum rotatably mounted with respect to a horizontal axis, means in said drum for releasably retaining medical parts fixed with respect to said drum, means for supplying temperature controlled water for a cleaning and disinfecting solution to said enclosure means including a hot and cold inlet supply means and a common discharge means from said supply means to said enclosure means, means in said common discharge means for sensing the temperature of water therein and for regulating the flow of water through one of said hot and cold inlet supply means for controlling the temperature of the inlet water, means for selectively draining the solution from said enclosure means, means for selectively supplying bacteriostatic filtered hot air to said enclosure means, means for venting said enclosure means and for admitting disinfectant chemical to the water to provide a disinfecting solution, and means for timing and controlling said inlet supply means, said draining means and said hot air means for sequential cleaning and disinfecting medical equipment in said drum.

3. The apparatus as defined in claim 2 and further including temperature sensor means in said venting means for controlling said hot air means.

4. An apparatus for cleaning and disinfecting medical equipment including enclosure means for receiving and retaining a cleaning and disinfecting solution, said enclosure means including a drum rotatably mounted with respect to a horizontal axis, means in said drum for releasably retaining tubular members in a circular configuration about said horizontal axis, means for supplying water for a cleaning and disinfecting solution for said enclosures, means for rotating said drum about said horizontal axis, means for selectively draining the solution from said enclosure means, means for selectively supplying bacteriostatic filtered hot air to said enclosure means, means for venting said enclosure means and for admitting disinfectant chemical to the water to provide a disinfecting solution, and means for timing and controlling said inlet supply means, said draining means and said hot air means for sequential cleaning and disinfecting medical equipment in said drum.

5. The apparatus as defined in claim 4 and further including temperature sensor means in said venting means for controlling said hot air means.

6. An apparatus for cleaning and disinfecting medical equipment including enclosure means for receiving and retaining a cleaning and disinfecting solution, said enclosure means including a drum rotatably mounted with respect to a horizontal axis, means in said drum for releasably retaining tubular members in a circular configuration about said horizontal axis, said retaining means including negator type springs circumferentially spaced about said drum, means for supplying water for a cleaning and disinfecting solution for said enclosures, and means for rotating said drum about said horizontal axis.

* * * * *